US010494314B2

(12) United States Patent
Blau

(10) Patent No.: US 10,494,314 B2
(45) Date of Patent: Dec. 3, 2019

(54) NON-LETHAL PAYLOADS AND METHODS OF PRODUCING SAME

(71) Applicant: Northrop Grumman Innovation Systems, Inc., Plymouth, MN (US)

(72) Inventor: Reed J. Blau, Richmond, UT (US)

(73) Assignee: Northrop Grumman Innovation Systems, Inc., Plymouth, MN (US)

( * ) Notice: Subject to any disclaimer, the term of this patent is extended or adjusted under 35 U.S.C. 154(b) by 550 days.

(21) Appl. No.: 15/133,567

(22) Filed: Apr. 20, 2016

(65) Prior Publication Data

US 2016/0229764 A1 Aug. 11, 2016

Related U.S. Application Data

(63) Continuation of application No. 13/672,411, filed on Nov. 8, 2012, now abandoned.

(60) Provisional application No. 61/659,351, filed on Jun. 13, 2012.

(51) Int. Cl.

| | |
|---|---|
| ***C06B 31/02*** | (2006.01) |
| ***F42B 33/00*** | (2006.01) |
| ***C06B 25/20*** | (2006.01) |
| ***C06B 29/00*** | (2006.01) |
| ***C06B 33/04*** | (2006.01) |
| ***C06C 15/00*** | (2006.01) |
| ***F42B 4/26*** | (2006.01) |
| ***F42B 12/42*** | (2006.01) |
| ***F42B 27/00*** | (2006.01) |

(52) U.S. Cl.

CPC ..... *C06B 31/02* (2013.01); *C06B 25/20* (2013.01); *C06B 29/00* (2013.01); *C06B 33/04* (2013.01); *C06C 15/00* (2013.01); *F42B 4/26* (2013.01); *F42B 12/42* (2013.01); *F42B 27/00* (2013.01); *F42B 33/00* (2013.01)

(58) Field of Classification Search

CPC . F42B 33/00; F42B 4/26; C06B 29/00; C06B 25/20; C06B 31/02

See application file for complete search history.

(56) References Cited

U.S. PATENT DOCUMENTS

| | | | |
|---|---|---|---|
| 3,309,249 | A | 3/1967 | Allen |
| 3,479,954 | A | 11/1969 | Bolieau |
| 3,601,053 | A | 8/1971 | Grall et al. |

(Continued)

FOREIGN PATENT DOCUMENTS

| | | |
|---|---|---|
| DE | 2164437 | 7/1973 |
| EP | 430464 A2 | 6/1991 |

(Continued)

OTHER PUBLICATIONS

Bender, Susan F.A., et al., "Less-than-lethal "Flashbang" Diversionary Device," Sand Report, SAND 2003-4045, Sandia Nat'l. Lab., Albuquerque, NM 87185 & Livermore, CA 94550, 26 pages, printed Nov. 2003.

(Continued)

*Primary Examiner* — Aileen B Felton
(74) *Attorney, Agent, or Firm* — TraskBritt

(57) ABSTRACT

Non-lethal payloads including at least one of boron and silicon, at least one fuel, and at least one oxidizer. The non-lethal payload may be a single-component or dual-component payload. Methods of producing the non-lethal payloads are also disclosed.

9 Claims, 4 Drawing Sheets

(56) References Cited

U.S. PATENT DOCUMENTS

| | | | | |
|---|---|---|---|---|
| 3,690,972 | A * | 9/1972 | Kaye | C06B 29/08 149/113 |
| 3,760,729 | A | 9/1973 | Freeman | |
| 3,788,908 | A * | 1/1974 | Franklin | C06B 27/00 102/513 |
| 3,895,578 | A | 7/1975 | Shaw et al. | |
| 4,204,895 | A | 5/1980 | Webster, III | |
| 5,654,523 | A | 8/1997 | Brunn | |
| 6,086,693 | A | 7/2000 | Mendenhall et al. | |
| 6,253,680 | B1 | 7/2001 | Grubelich | |
| 6,607,214 | B2 | 8/2003 | Blakemore et al. | |
| 6,964,287 | B1 | 11/2005 | Nesveda et al. | |
| 6,982,014 | B1 | 1/2006 | Muneno et al. | |
| 7,578,895 | B1 | 8/2009 | Chen et al. | |
| 7,603,951 | B2 | 10/2009 | Rose et al. | |
| 7,963,227 | B1 | 6/2011 | Brunn | |
| 8,117,966 | B1 | 2/2012 | Graber | |
| 8,172,966 | B2 | 5/2012 | Blau et al. | |
| 2005/0115721 | A1 | 6/2005 | Blau et al. | |
| 2010/0024932 | A1* | 2/2010 | Webb | C06B 25/18 149/63 |
| 2010/0180787 | A1* | 7/2010 | Hagel | C06C 7/00 102/201 |
| 2010/0212533 | A1* | 8/2010 | Brunn | F42B 4/26 102/502 |
| 2010/0288403 | A1 | 11/2010 | Busky et al. | |
| 2011/0168305 | A1 | 7/2011 | Blau et al. | |
| 2011/0226984 | A1 | 9/2011 | Nimi et al. | |

FOREIGN PATENT DOCUMENTS

| | | | |
|---|---|---|---|
| WO | 9402435 | A1 | 2/1994 |
| WO | 9912871 | A1 | 3/1999 |
| WO | 0248641 | A1 | 6/2002 |
| WO | 2012072198 | A2 | 6/2012 |

OTHER PUBLICATIONS

Blau et al., Hexachloroethane Obscurant Replacement, Final Report, SERDP Project WP-2149, Jan. 2012, 67 pages.

Lakshminarayanan, G.R., et al., Evaluation of Alternative Fuel and Binder Materials in Hand Held Signals Illuminant Compositions Technical Report ARWEC-TR-99008, U.S. Army Armament Research, Development and Engineering Center, Warheads, Energetics & Combat-Support Armament Center, Picatinny Arsenal, New Jersey, 45 pages, Nov. 2000.

Military Specification entitled Pellets/Granules/Boron/Potassium Nitrate; MIL-P-46994B dated Jan. 4, 1982, (20 pages).

Pyrocreations, http://www.pyrocreations.com/colored_stars, visited Dec. 11, 2013, 13 pages.

International Search Report for International Application No. PCT/US2012/064144, dated Aug. 22, 2013, five (5) pages.

Whittaker et al., Magnesium Aluminum Borides as Explosive Materials, Report, Dec. 20, 2011, 105 pages.

Written Opinion of the International Searching Authority for International Application No. PCT/US2012/064144, dated Aug. 22, 2013, six (6) pages.

* cited by examiner

NON-LETHAL PAYLOADS AND METHODS OF PRODUCING SAME

CROSS-REFERENCE TO RELATED APPLICATIONS

This application is a continuation of U.S. patent application Ser. No. 13/672,411, filed Nov. 8, 2012, which claims the benefit of U.S. Provisional Patent Application Ser. No. 61/659,351, filed Jun. 13, 2012, the entire disclosure of each of which is hereby incorporated herein in its entirety by this reference.

This application is related to U.S. patent application Ser. No. 13/457,996, filed Apr. 27, 2012 which is a divisional of U.S. patent application Ser. No. 11/369,908, filed Mar. 7, 2006, now U.S. Pat. No. 8,172,966, issued May 8, 2012, each of which is assigned to the assignee of the present application and the entire disclosure of each of which is hereby incorporated herein in its entirety by this reference.

TECHNICAL FIELD

The present disclosure relates generally to formulations for use as non-lethal payloads and methods of producing the formulations. More specifically, the present disclosure relates to formulations for non-lethal payloads including at least one of boron and silicon, at least one fuel, and at least one oxidizer. The formulations are produced by a dry blending process.

BACKGROUND

Non-lethal devices and diversionary devices, such as so-called "flash-bang" devices, are used by military, law enforcement, security and other personnel to provide diversions or initial stages in escalation of force in combat or operational situations or to provide demonstrations and simulated combat conditions during training. When activated, the non-lethal devices or diversionary devices deliver a flash of light and sound to an area surrounding the activated device. The level of light and sound output is designed to temporarily incapacitate people within the proximity of the activated device with a calculated risk of permanent injuries depending on the given stage in the escalation of force. The flash of light (e.g., a fireball) may temporarily blind a person viewing the fireball, and the sound or pressure impulse produced by the device may incapacitate a person's auditory capabilities. The desired effect of the non-lethal device is to temporarily distract or incapacitate people within a general vicinity of the device when the device is activated. Ideally, the device does not permanently injure or fatally wound the people exposed to the effects of an activated device. With these goals in mind, non-lethal or less than lethal devices have been developed to deliver the desired fireball area as well as integrated light output (flash) and corresponding pressure impulse (bang).

Legacy flash/bang formulations used in non-lethal devices are designed primarily to produce a pressure impulse to warn, divert attention, or cause a temporary threshold shift in the hearing of a person. The legacy flash/bang formulations include a powdered oxidizer, such as a perchlorate-based oxidizer, in combination with a metal, such as magnesium or aluminum. Magnesium and aluminum have been used as the metal that is the primary source of the light output upon its oxidation whereas the presence of the perchlorate-based oxidizer blended with the metal promotes oxidation of the metal within milliseconds, very rapidly producing heat and concomitant gas expansion in the form of a pressure impulse.

U.S. Pat. No. 8,172,966 describes a non-lethal payload that includes an igniter/activator and an illuminant. When initiated, the igniter/activator produces a sufficiently high temperature to initiate the illuminant. The igniter/activator includes a granular composition of boron/potassium nitrate ($B/KNO_3$), a granular composition of magnesium strontium nitrate ($Mg/Sr(NO_3)_2$), or a combination of $B/KNO_3$ and $Mg/Sr(NO_3)_2$. The igniter/activator includes a binder to facilitate the handling or production of the igniter/activator. The illuminant includes a powdered metal, such as powdered aluminum or powdered magnesium and, optionally, an oxidizer. In some configurations, the illuminant is fuel rich and relies on the reaction of the powdered metal with oxygen in the air. Many of these configurations produce a significantly greater integrated light output than legacy flash/bang formulations. Because light evolution is dependent, at least in part, upon oxidation of the powdered metal with air, flash duration may extend beyond 100 milliseconds. It has been determined that while these non-lethal payloads are effective, a non-lethal payload including only a powdered metal as the illuminant was not efficient because either the non-lethal payload was not totally dispersed upon initiation, or the reaction of the powdered metal was quenched before complete combustion occurred.

Pyrotechnic formulations including boron, such as the granular composition of the igniter/activator described above, have conventionally been produced using a binder, such as a polymer. Granules of the igniter/activator are produced by dissolving the binder in a solvent, wetting the other dry ingredients of the igniter/activator with the solvent by a slurry mixing process, evaporating the solvent, and granulating the wet paste. The wet paste is dried and then dry granulated to produce the granular form of the $B/KNO_3$ component of the igniter/activator. The granular $Mg/Sr(NO_3)_2$ component of the igniter/activator is produced in a similar manner. However, the $B/KNO_3$ and $Mg/Sr(NO_3)_2$ of the igniter/activator tend to segregate after these components are combined. The segregation of the components of the igniter/activator may be viewed visually where agglomerations of the $B/KNO_3$ are brown in color and those of $Mg/Sr(NO_3)_2$ are silver in color. Agglomerations, indicating the segregation of the components of the igniter/activator, may also be determined by chemical analysis. Thus, the igniter/activator prepared by the granulation process may be a heterogeneous material including agglomerations of boron and potassium nitrate, agglomerations of magnesium and strontium nitrate, and/or agglomerations of boron, potassium nitrate, magnesium, and strontium nitrate.

Processing of a granular igniter/activator is time and labor intensive due first to the labor intensive slurry mixing, wet granulation, drying, and dry granulation process described above. Additional labor is also used to blend and load the granular $B/KNO_3$ and granular $Mg/Sr(NO_3)_2$ components of an igniter/activator into a device in a manner that promotes a consistent blend ratio from one device to the next, and mitigates desegregation of components once loaded. It would be desirable to produce a non-lethal payload that provides a desired light and sound output by a less labor and time intensive process.

BRIEF SUMMARY

A non-lethal payload is disclosed. The non-lethal payload comprises an illuminant and an igniter. The illuminant comprises at least one fuel, at least one oxidizer, and at least one of boron and silicon. The igniter comprises at least one fuel and at least one oxidizer.

Also disclosed is a non-lethal payload comprising at least one fuel, at least one oxidizer, and at least one of boron and silicon. The at least one of boron and silicon comprises from approximately 5% by weight to approximately 25% by weight of the non-lethal payload.

A method of forming a non-lethal payload is also disclosed. The method comprises combining at least one fuel, at least one oxidizer, and at least one of boron and silicon in the absence of any solvent.

DETAILED DESCRIPTION

Figure 1:
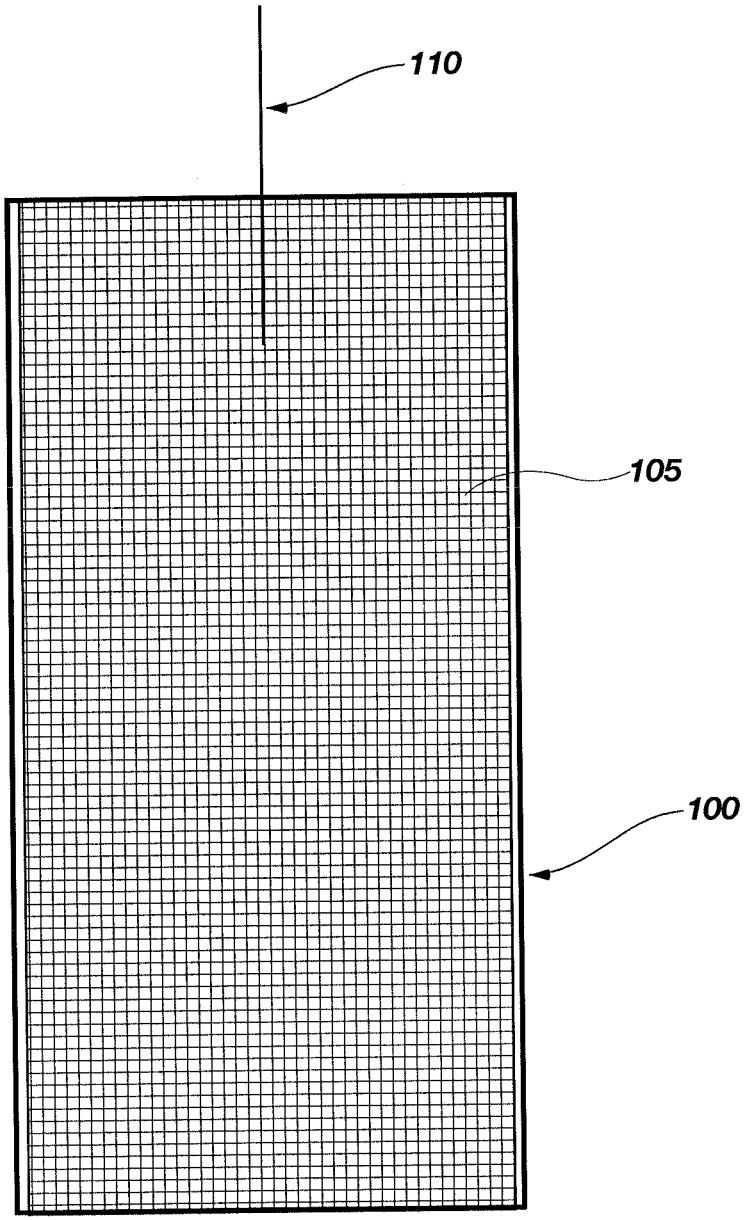
FIG. 1 illustrates an embodiment of a non-lethal device for delivering a single-component payload.

A formulation for use as a non-lethal payload is described. The formulation may be used in a non-lethal device (e.g., a diversionary device), such as in a flash bang device. The formulation includes at least one of boron and silicon, at least one fuel, and at least one oxidizer. The non-lethal payload may be a dual-component payload, in which the at least one of boron and silicon is present in an illuminant, or may be a single-component payload including the at least one of boron and silicon. As used herein, the term "dual-component payload" means and includes a non-lethal payload in which a formulation for an igniter is present in addition to the formulation for the illuminant. As explained in more detail below, the igniter may initiate or activate combustion of the illuminant. The igniter may also be referred to as an activator or an igniter/activator. The illuminant and igniter of the dual-component payload may be combined, layered, or otherwise configured for the igniter to initiate the illuminant. The illuminant in combination with the igniter produces the desired light and sound output (e.g., fireball area, integrated light intensity, peak impulse pressure) of the initiated non-lethal payload. If the non-lethal payload is a dual-component payload, the igniter may be used to initiate the illuminant. As used herein, the term "single-component payload" means and includes a non-lethal payload in which a single formulation is present and produces the desired sound and light output of the non-lethal payload. The ingredients of the single-component payload may be combined, layered, or otherwise configured for initiation of the single-component payload. If the non-lethal payload is a single-component payload, the formulation may be initiated by an ignition assembly. Once initiated, the non-lethal payload is configured to produce sound and light that temporarily distracts or impairs the vision and hearing of a person located in proximity to the non-lethal device.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be excluded.

The illustrations presented herein are not meant to be actual views of any particular non-lethal device, but are merely idealized representations that are employed to describe the present disclosure. The figures are not necessarily drawn to scale. Additionally, elements common between figures may retain the same numerical designation.

The formulation of the dual-component payload may include the illuminant and the igniter. The illuminant includes the metalloid (e.g., at least one of boron and silicon), at least one fuel, and at least one oxidizer. The boron or silicon may be an elemental (e.g., active) form of the boron or silicon and may function as a fuel when the illuminant is initiated. The boron or silicon may be a powder having a high surface area, such as between approximately 2 $m^2/g$ and approximately 30 $m^2/g$. As used herein, the term "powder" means and includes a solid material in the form of unbound particles. The powder may include particles of a variety of shapes, such as spherical, cylindrical, chipped, flakes, or other shapes. The boron or silicon may have a small particle size, such as less than approximately 3 μm for boron or less than or equal to approximately 20 μm for silicon. The boron or silicon may have a particle size of approximately 1 μm or may be sub-micron e.g., having a particle size of less than approximately 1 μm. In one embodiment, the boron or silicon has a particle size of approximately 1 μm. The boron or silicon may be present in the illuminant in a crystalline form or an amorphous form. The boron or silicon powder may include elemental boron or elemental silicon at a sufficient purity to contribute to the desired illuminance of the non-lethal payload, along with the fuel of the illuminant, if present, such as having a purity of greater than approximately 80%. The powder may also include compounds of boron or compounds of silicon. In one embodiment, amorphous boron powder is used in the illuminant, the amorphous boron powder being 90%-92% pure (e.g., containing 89%-91% active boron). However, different grades of boron or silicon may be used depending on cost considerations or the desired sound and light output of the non-lethal payload. Different grades of amorphous or crystalline boron, in powder form, are commercially available, such as from Tronox Limited (Stamford, Conn.). Different grades of amorphous or crystalline silicon, in powder form, are commercially available, such as from Hummel Croton Inc. (South Plainfield, N.J.).

The boron, silicon, or a combination thereof may be present in the illuminant at from approximately 2% by weight (wt %) to approximately 30 wt %, such as from approximately 5 wt % to approximately 25 wt %, from approximately 2 wt % to approximately 20 wt %, or from approximately 4 wt % to approximately 15 wt %. The fuel and oxidizer, in combination, may account for the remainder of the illuminant, such as from approximately 70 wt % to approximately 99 wt %.

The fuel may be a metal, such as magnesium, aluminum, titanium, zirconium, other reactive transition metal, or a combination thereof. The fuel may also include metal hydrides, borides, nitrides, or carbides of the fuel, such as $ZrH_2$, $TiH_2$, $TiB_2$, TiN, ZrC, $B_4C$, or a combination thereof. A powder form of the fuel may be used, with particles of the fuel having a particle size of less than about 100 μm, such as approximately 90 μm or approximately 80 μm. In a dual-component payload, the illuminant may include a higher fuel content than in the igniter. In one embodiment, the fuel of the illuminant is a magnesium powder, such as a spherical magnesium powder. For example, a 65-μm spherical magnesium powder may be used. However, other sizes, shapes, and diameters of magnesium powder may be used, such as chipped magnesium. In another embodiment, the fuel is an aluminum powder, such as a spherical aluminum powder. For example, a 5-μm spherical aluminum powder may be used. However, other sizes, shapes, and diameters of aluminum powder may be used, such as high surface area, flaked, or coated aluminum (also known as dark pyro aluminum). The fuel may be present in the illuminant at from approximately 20 wt % to approximately 98 wt %.

The oxidizer may include an inorganic oxidizer, such as an ammonium nitrate, an alkali metal nitrate, an alkaline earth nitrate, a transition metal nitrate, an ammonium perchlorate, an alkali metal perchlorate, an alkaline earth perchlorate, an alkali metal peroxide, or an alkaline earth peroxide, such as potassium nitrate, sodium nitrate, or strontium nitrate, or a combination thereof. The oxidizer may be present at from approximately 1 wt % to approximately 80 wt % of the illuminant. A powder form of the oxidizer may be used, with particles of the oxidizer having a particle size of less than about 100 μm, such as approximately 15 μm. The oxidizer may affect the rise time of the illuminance of the non-lethal payload by decreasing the rise time, or amount of time from the activation of the non-lethal payload to achievement of a maximum illuminance, of the non-lethal payload. The addition of the oxidizer may also affect the amount of illuminance (e.g., integrated illuminance) produced by the non-lethal payload.

The illuminant may, optionally, include a binder, such as an energetic binder or a non-energetic binder, to improve the handling qualities of the illuminant. However, to reduce the processing complexity, in one embodiment, the illuminant does not include a binder. The illuminant may, optionally, include graphite or carbon black. In some embodiments, carbon black or similar substances may be present to promote static charge dissipation during mixing and handling of the illuminant.

In one embodiment, the illuminant of the dual-component payload includes potassium nitrate, magnesium, strontium nitrate, and boron, such as 23.0 wt % potassium nitrate, 65.0 wt % magnesium, 4 wt % strontium nitrate, and 8 wt % boron. The strontium nitrate may have a particle size of approximately 15 μm, the magnesium may have a particle size of approximately 80 μm or approximately 90 μm, the potassium nitrate may have a particle size of approximately 25 μm, and the boron may have a particle size of approximately 1 μm.

The illuminant of the dual-component payload may be produced by combining the fuel, oxidizer, and at least one of boron and silicon. Dry powders of the fuel, oxidizer, and at least one of boron and silicon may be combined and mixed by conventional techniques, which are not discussed in detail herein. The dry blending process may be conducted without utilizing a binder or a solvent. If optional ingredients are present, the optional ingredients may also be combined and mixed with the other ingredients. The ingredients of the illuminant may be combined until a homogeneous formulation is achieved. In one embodiment, the illuminant of the dual-component payload is produced by dry blending magnesium, strontium nitrate, potassium nitrate, and boron powders until the ingredients are uniformly dispersed. Thus, the illuminant may be a homogeneous composition when viewed by scanning electron microscopy (SEM) or SEM Energy Dispersive X-ray Spectroscopy (SEM EDX).

The igniter of the dual-component payload may include at least one fuel and at least one oxidizer. The fuel may be one of the fuels described above, and the oxidizer may be one of the oxidizers described above. In one embodiment, the fuel is a metal, such as magnesium or aluminum. The fuel may be present at from approximately 20 wt % to approximately 85 wt % of the igniter. In one embodiment, the oxidizer is potassium nitrate, strontium nitrate, or a combination thereof. The oxidizer may be present at from approximately 15 wt % to approximately 80 wt % of the igniter. The igniter may, optionally, include at least one of silicon and boron. If present, the boron, silicon, or a combination thereof may account for from approximately 1 wt % to approximately 30 wt % of the igniter, such as from approximately 2 wt % to approximately 20 wt % or from approximately 4 wt % to approximately 15 wt %. In one embodiment, the igniter includes potassium nitrate, magnesium, strontium nitrate, and boron, such as 21 wt % potassium nitrate, 38 wt % magnesium, 33 wt % strontium nitrate, and 8 wt % boron. The strontium nitrate may have a particle size of approximately 15 μm, the magnesium may have a particle size of approximately 80 μm, the potassium nitrate may have a particle size of approximately 25 μm and the boron may have a particle size of approximately 1 μm.

The igniter of the dual-component payload may be produced by combining the fuel, oxidizer, and any optional ingredients, such as at least one of boron and silicon. Dry powders of the fuel, oxidizer, and any optional ingredients may be combined and mixed by conventional techniques, which are not discussed in detail herein. The ingredients of the igniter may be combined until a homogeneous formulation is achieved. In one embodiment, the igniter of the dual-component payload is produced by dry blending magnesium, strontium nitrate, potassium nitrate, and boron powders until the ingredients are uniformly dispersed. Thus, the illuminant may be a homogeneous composition when viewed by SEM or SEM EDX.

The ingredients of the dual-component payload may function to stabilize the illuminant or the igniter, may enhance the combustion rate of the illuminant or the igniter, or may improve the illuminance (e.g., light output) produced upon ignition of the illuminant, such as by increasing the visible light output of the combusting illuminant.

In one embodiment, each of the illuminant and the igniter of the dual-component payload is substantially free of a binder. Thus, the dual-component payload is substantially free of a binder. By appropriately selecting the ingredients of the illuminant and the igniter and their respective amounts and particle sizes, the illuminant and the igniter of the present disclosure may be sufficiently insensitive to friction, electrostatic discharge, or impact that no binder is utilized to facilitate their handling or to facilitate their loading into the non-lethal device. Since the illuminant and the igniter of the present disclosure do not include the binder, when the formulations are viewed using SEM, the formulations may be visually different from legacy formulations that include a binder. When viewed by SEM, the illuminant and the igniter of the present disclosure may be substantially free of agglomerations of the ingredients in contrast to legacy formulations that include agglomerations of the ingredients due to the presence of the binder. In addition, if any agglomerations are present in the illuminant and the igniter of the present disclosure, the agglomerations may be substantially homogeneous compared to those of the legacy formulations.

In a single-component payload, the at least one of boron and silicon may account for from approximately 1% by weight (wt %) to approximately 30 wt % of the formulation, such as from approximately 2 wt % to approximately 20 wt % or from approximately 4 wt % to approximately 15 wt %. The remainder of the single-component payload may be the at least one fuel and the at least one oxidizer, in combination. The fuel may be one of the fuels described above as the fuel of the illuminant, and the oxidizer may be one of the oxidizers described above as the oxidizer of the illuminant.

In one embodiment, the single-component payload includes magnesium, strontium nitrate, potassium nitrate, and boron powders, such as 23.4 wt % potassium nitrate, 10 wt % strontium nitrate, 57.6 wt % magnesium, and 9 wt % boron. The strontium nitrate may have a particle size of approximately 15 μm, the magnesium may have a particle size of approximately 90 μm, the potassium nitrate may have a particle size of approximately 25 μm, and the boron may have a particle size of approximately 1 μm.

The single-component payload may also be produced by a dry blending process. Dry powders of the fuel, oxidizer, and at least one of boron and silicon may be combined and mixed by conventional techniques, which are not discussed in detail herein. The ingredients of the single-component payload may be combined until a homogeneous mixture is achieved. In one embodiment, the single-component payload is produced by dry blending magnesium, strontium nitrate, potassium nitrate, and boron powders until the ingredients are uniformly dispersed. Thus, the illuminant may be a homogeneous composition when viewed by SEM or SEM EDX.

In one embodiment, the single-component payload is substantially free of a binder. By appropriately selecting the ingredients of the single-component payload and their respective amounts and particle sizes, the single-component payload of the present disclosure may be sufficiently insensitive to friction, electrostatic discharge, or impact that no binder is utilized to facilitate their handling or to facilitate their loading into the non-lethal device. Since the single-component payload of the present disclosure does not include the binder, when the formulations are viewed using SEM, the formulations may be visually different from legacy formulations that include a binder. When viewed by SEM, the single-component payload of the present disclosure may be substantially free of agglomerations of the ingredients in contrast to legacy formulations that include agglomerations of the ingredients due to the presence of the binder. In addition, if any agglomerations are present in the single-component payload of the present disclosure, the agglomerations may be substantially homogeneous compared to those of the legacy formulations.

In the single or dual-component payloads, the amount of fuel relative to oxidizer may be determined by the desired performance (light and sound output) of the non-lethal payload. If a large sound output and a small light output are desired, the non-lethal payload may include a greater amount of the oxidizer relative to fuel. If a large light output and a small sound output are desired, the non-lethal payload may include a lesser amount of the oxidizer relative to fuel.

The non-lethal payloads of the embodiments of the present disclosure produce a comparable or increased light and sound output in comparison to a conventional non-lethal payload in which boron, silicon, or a combination thereof is absent. The presence of the boron or silicon in the single-component payload or in the illuminant of the dual-component payload provides increased pressure impulse and illuminance compared to a formulation lacking the boron or silicon. Without being bound by any theory, the presence of the boron or silicon in the single-component payload or in the illuminant of the dual-component payload is believed to increase the flame spread upon initiation of the single-component payload or illuminant compared to a formulation lacking the boron or silicon. In addition, it has been determined that formulations including boron at particle sizes of approximately 1 μm or less are less sensitive to handling than legacy flash/bang formulations including aluminum or magnesium of the same particle size. The presence of the boron or silicon in the formulations of the present disclosure (e.g., the single-component payload or the illuminant of the dual-component payload) may also increase the ignition reliability of the single-component payload or illuminant of the dual-component payload.

It was unexpected for the non-lethal payloads of the present disclosure to exhibit improved performance (e.g., an improved illuminance and sound output) compared to legacy flash/bang formulations lacking the boron or silicon. Based on knowledge of the legacy flash/bang formulations, one of ordinary skill in the art would have expected additional magnesium or aluminum to be needed to achieve the improved integrated illuminance of the formulations. One of ordinary skill in the art would not have expected the addition of boron or silicon to improve integrated illuminance because, when present in energetic formulations, these metalloids have conventionally been viewed as providing improved ignition and faster reaction rate to the energetic formulations. The faster reaction rate, as indicated by a faster rise rate, often contributes to a higher pressure impulse or bang. Thus, the addition of ingredients that improve ignition and increase the reaction rate of the non-lethal payloads was not expected to improve the light output of the non-lethal payloads. In many instances, both light and sound output were expectedly improved by the addition of boron. In the case of the single-component payload designed to produce a large light output (low oxidizer content), the presence of boron provided consistent ignition of the payload.

Furthermore, by utilizing a dry blending process to produce the formulations (single-component payload, illuminant of the dual-component payload, igniter of the dual-component payload) of the non-lethal payloads, the formulations may be produced in a simple and less time intensive manner than conventional processes having binders, which require multiple process acts. In addition, it was unexpected that the formulations of the present disclosure did not segregate into their individual ingredients. When observed visually, such as microscopically, the non-lethal payload remains a homogeneous composition and does not segregate into the respective ingredients.

The formulations (single-component payload, illuminant of the dual-component payload, igniter of the dual-component payload) may be loaded into the non-lethal device by conventional techniques. With a dual-component payload, the illuminant and igniter may be contained in different locations of the non-lethal device. The illuminant and igniter may be in direct contact with one another or may be separated by a divider, such as a foam divider. The illuminant and igniter may be layered, shaped in a radial design, or otherwise tailored in relation to one other to provide the desired light and sound output and a desired fireball from the non-lethal payload when initiated. In one embodiment, the non-lethal payload may be contained in a non-lethal device, as illustrated in FIG. 1, which is a cross-sectional view of a device casing 100 containing the single-component payload 105 as the non-lethal payload. The device casing 100 may have a cylindrical shape as illustrated and may be constructed of a material such as cardboard, cardstock, brittle plastic, or a foam-based material that will not produce lethal shrapnel upon activation of the non-lethal payload. However, the device casing 100 may be constructed of a rigid material that will not fracture upon activation and distribution of the non-lethal payload, such as metal or a polymer material, with openings in the casing material (not shown) to release portions of the non-lethal payload upon activation. An initiation device 110, such as a fuse or an electric match, may be placed through a portion of the device casing 100 so that the initiation device 110 or combustion products therefrom may contact the non-lethal payload.

Figure 2:
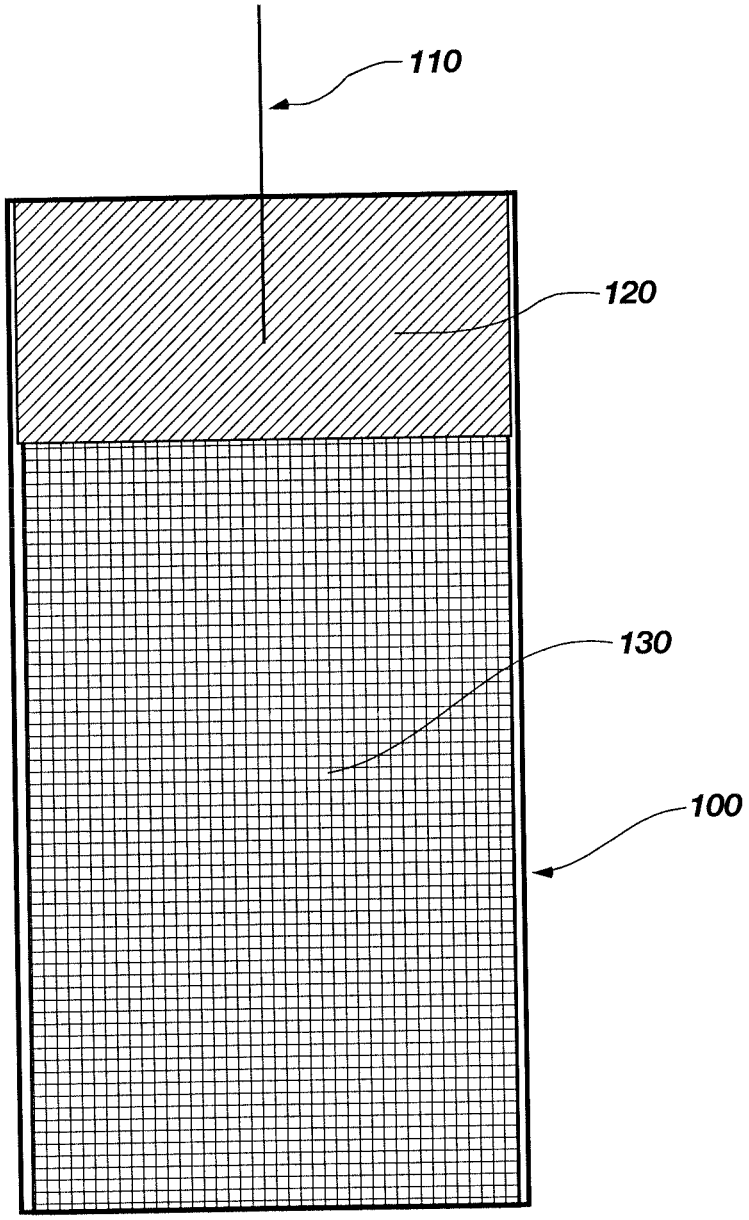
FIG. 2 illustrates an embodiment of a non-lethal device for delivering a dual-component payload having a layered configuration.

In an embodiment where the non-lethal payload is a dual-component payload, the igniter 120 and the illuminant 130 may be layered in a non-lethal device as illustrated in FIG. 2. The non-lethal payload may be positioned in the device casing 100 such that the igniter 120 overlies the illuminant 130. However, the positions may be reversed so that the illuminant 130 overlies the igniter 120 (not shown). As previously described, the device casing 100 may be made from materials that will not produce lethal shrapnel upon activation of the non-lethal payload. An initiation device 110, such as a fuse, may be placed through a portion of the device casing 100 where it may contact the igniter 120 of the non-lethal payload.

Figure 3:
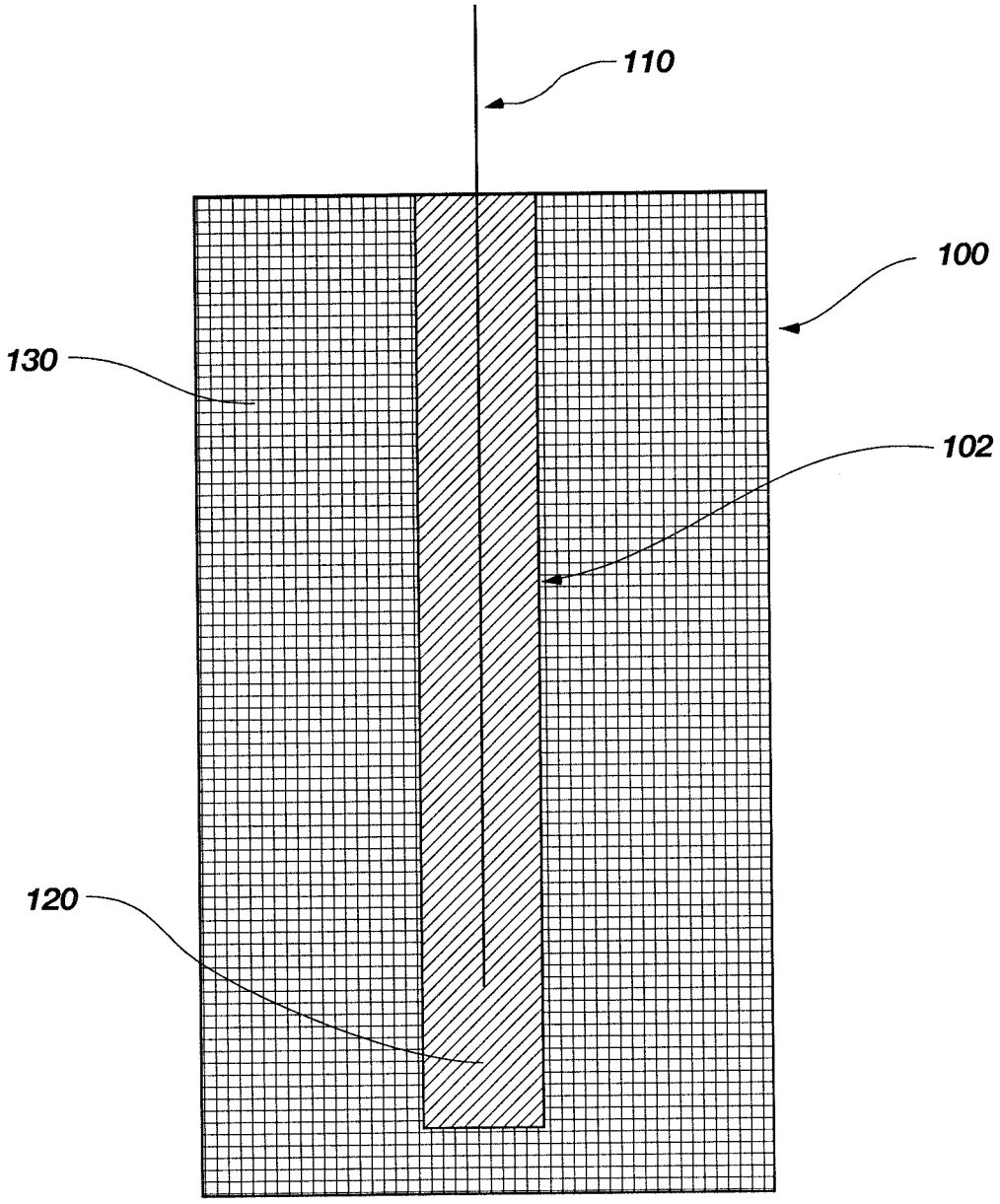
FIG. 3 illustrates an embodiment of a non-lethal device for delivering a dual-component payload having a radial configuration.

In another embodiment where the non-lethal payload is a dual-component payload, the non-lethal payload may be positioned in the device casing 100 such that the illuminant 130 of the non-lethal payload surrounds the igniter 120 or a casing 102 holding the igniter 120, as illustrated in FIG. 3. The igniter 120 may be positioned in an interior casing 102 of the device casing 100 and the illuminant 130 may be placed in an annulus surrounding an outer wall of the interior casing 102 and an inner wall of the device casing 100. The size, or diameter, of the interior casing 102 may be varied such that the amount of igniter 120 to illuminant 130 may be tailored for the desired non-lethal payload. An initiation device 110 may pass through the device casing 100 and into the interior portion of the interior casing 102 where the igniter 120 is positioned. The initiation device 110 may also be placed near either end of the interior casing 102. Activation of the igniter 120 by the initiation device 110 may result in the combustion products from the igniter 120 expelling the illuminant 130 out of the device casing 100 in a radial direction from the interior casing 102 and igniting the illuminant 130 to produce a fireball. Once expelled, fuel components of the igniter 120 and illuminant 130 may react with the air, enhancing the overall flash performance of the device. As with the layered device in FIG. 2, the device casing 100 and the interior casing 102 may be made from materials that will not produce lethal shrapnel upon activation of the non-lethal payload.

Figure 4:
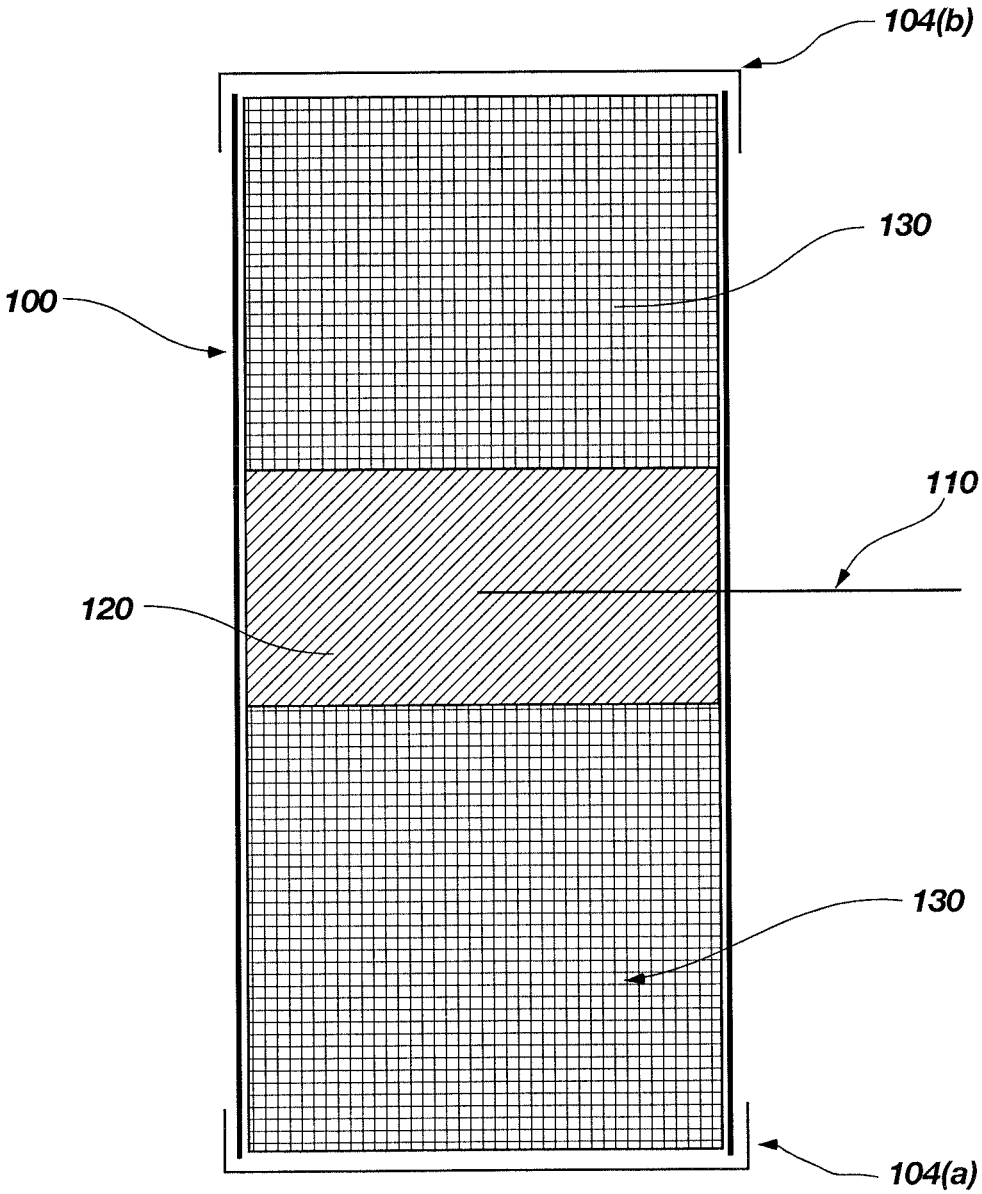
FIG. 4 illustrates an embodiment of a non-lethal device for delivering a dual-component payload.

In another embodiment where the non-lethal payload is a dual-component payload, a device casing 100 may be made of a material that will not fragment or otherwise decompose upon activation of the non-lethal payload contained within the device casing 100, as illustrated in FIG. 4. Openings 104(*a*) and 104(*b*) in device casing 100 may be sealed with a material that will allow the illuminant 130 within the device casing 100 to escape from the device casing 100 when the igniter 120 is activated by the initiation device 110. Thus, if an operator is holding the device by the device casing 100 and the non-lethal payload is accidentally activated, the operator may not suffer permanent injury or a fatal wound from the device casing 100 disintegrating in the operator's hand. Although the operator may be exposed to the effects of activation of the non-lethal payload, a permanent injury may be avoided, which is a concern with conventional non-lethal devices.

Use of the formulations of the present disclosure may simplify the loading of the non-lethal device. In a non-lethal device including the single-component payload, the process may be simplified because only a single formulation, the single-component payload, needs to be loaded into the non-lethal device. Since only a single formulation is to be loaded, masking and protection acts that are needed when loading a dual-component payload do not need to be conducted. Thus, there are reduced labor and fabrication costs for loading the single-component payload into the non-lethal device. The process of loading the dual-component payload into the non-lethal device may also be simplified because both the illuminant and the igniter are powdered formulations that do not segregate during loading and handling compared to systems containing two types of agglomerants (granules) or a combination of powder and agglomerated components.

In use and operation, the igniter of the dual-component payload, once initiated, may provide sufficient heat to activate the illuminant and may also function to disperse the illuminant. The illuminant, once initiated, may produce the desired light and sound output when reacted with oxygen in the air. The igniter may contribute additional illuminance to the non-lethal payload. Similarly, the single-component payload, once initiated, may provide the desired light and sound output when reacted with oxygen in the air. The light produced by the non-lethal payload may be of sufficient intensity to cause a targeted person to experience visual stress, especially in low-light situations, such as at night or dawn/dusk. The sound produced by the non-lethal payload may be of sufficient intensity to temporarily incapacitate a person's auditory capabilities.

The non-lethal payload of the present disclosure may be used in a conventional non-lethal device, such as in non-lethal grenades (including hand-held grenades), non-lethal munitions (including 40 mm, 66 mm, etc.), indirect fire non-lethal munitions, 12-gauge shot shells, and simulators, such as grenade simulators, airburst simulators, ground burst simulators, or IED simulators.

The following examples serve to explain embodiments of the present disclosure in more detail. These examples are not to be construed as being exhaustive or exclusive as to the scope of this disclosure.

EXAMPLES

Example 1

Cylindrical Test Vehicle Performance

Formulations A-C were tested in a cylindrical test vehicle in which the igniter was placed in a central flash tube fabricated with sixteen outlet holds. The outer diameter of the flash tube was sealed with a wrapping of aluminum tape to block the holes in the flash tube and prevent leakage of the igniter into an annulus of the flash tube. The illuminant was loaded into the annulus between the flash tube and an outer body of the test vehicle. An electric match was inserted into the flash tube through the top of the test vehicle to activate the test vehicle. Cameras and test gauges were set up surrounding the test vehicle according to measure the flash intensity and the magnitude of the pressure impulse upon activation of the test vehicle. The cameras and test gauges used to measure the flash intensity and pressure impulse were set up according to conventional techniques.

The flash intensity and pressure impulse of Formulations A-C were determined and are reported in Table 1. Duplicate tests were conducted for each formulation. Formulation B, a dual-component payload, included an igniter and an illuminant. The illuminant included 23.0 wt % $KNO_3$, 65.0 wt % magnesium, 4 wt % $Sr(NO_3)_2$, and 8 wt % B, and the igniter included 21 wt % $KNO_3$, 38 wt % magnesium, 33 wt % $Sr(NO_3)_2$, and 8 wt % B. Each of the illuminant and igniter of Formulation B were produced by dry blending processes. Each of the illuminant and igniter of Formulation B included the same ingredients except the illuminant had a significantly higher fuel content than the igniter. Formulation C, a single-component payload, included 70.9 wt % magnesium and 29.1 wt % $Sr(NO_3)_2$. The pressure and light output for each of Formulations B and C was compared to that of a dual-component payload designated below as Formulation A, which included a granular mix of 70 wt % $Mg/Sr(NO_3)_2$ (available from Alliant Techsystems Inc. as UIX 191) and 30 wt % $B/KNO_3$ (available from Alliant Techsystems Inc. as UIX 156) as the igniter, and a mixture of 59.3 wt % magnesium powder, 32.7 wt % UIX 156, and 8.0 wt % UIX 191 as the illuminant.

The pressure and light output data for Formulations A-C are shown in Table 1. Each formulation was tested in duplicate.

TABLE 1

Pressure and Light Output of Formulations A-C

| Formulation | Peak Pressure, (0° at 1 m) | Peak Pressure, (45° at 2 m) | Peak Pressure, (45° at 3 m) | Axial Peak Photopic (klux) | Radial Peak Photopic (klux) | Axial-0.25 sec. Integrated Photopic (klux * s) | Radial-0.25 sec. Integrated Photopic (klux * s) | Avg 0.25 sec. Integrated Photopic (klux * s) |
|---|---|---|---|---|---|---|---|---|
| A | 0.31 | 0.17 | 0.12 | 63 | 36 | 10.3 | 0.9 | 5.6 |
| A | 0.49 | 0.28 | 0.12 | 108 | 74 | 11.0 | 1.5 | 6.3 |
| B | 1.46 | 0.79 | 0.45 | 195 | 99 | 14.7 | 5.4 | 10.1 |
| B | 1.54 | 0.66 | 0.35 | 256 | 119 | 16.4 | 6.5 | 11.5 |
| C | 0.16 | 0.08 | 0.04 | 144 | 114 | 8.0 | 6.9 | 7.5 |
| C | 0.12 | 0.07 | 0.04 | 140 | 107 | 9.1 | 4.2 | 6.7 |

As shown in Table 1, Formulation B, which included the dry blended igniter and dry blended illuminant, produced a brighter flash and a significant pressure impulse compared to Formulation A, which contained a blended granular igniter and granular components in the illuminant. This finding was significant for three reasons. First, production of dry blended powders is significantly less labor intensive than producing two different granular components using a slurry mixing process that involves two solvent evaporation and two granulation processes followed by dry blending of the two granule types to foam the igniter, and dry blending the two granule types with magnesium as the illuminant. Second, igniters and illuminants with granular components have a greater proclivity towards particle segregation. Third, conventional pyrotechnics including boron also contain binder. However, Formulation B contained boron in an unbound, dry state. A comparison of the performance of Formulation B to that Formulation C, the single-component payload, showed that Formulation C exhibited decreased pressure impulse and the integrated light output for Formulation C was lower. This suggests the presence of boron and/or potassium nitrate provided enhanced performance for Formulation B. Formulation C had comparable light output to Formulation A but the impulse pressure was lower, which may be desirable in certain applications. In addition, labor costs to produce and load Formulation C in a device would be significantly lower than that for Formulation A with its granular components.

Example 2

Shotshell Test Vehicle Performance

The pressure and light output for non-lethal payload formulations was tested in 12-gauge shotshells as the test vehicle. The formulations included Formulation B as described above. For comparison, a formulation including a granular mix (70:30) of $Mg/Sr(NO_3)_2$ (available from Alliant Techsystems Inc. as UIX 191) and $B/KNO_3$ (available from Alliant Techsystems Inc. as UIX 156) as the igniter, and 59.3 wt % magnesium, 32.7 wt % $B/KNO_3$ (available from Alliant Techsystems Inc. as UIX 156), and 8 wt % $Mg/Sr(NO_3)_2$ (available from Alliant Techsystems Inc. as UIX 191) was prepared and is designated below as Formulation D. An additional formulation lacking boron in the illuminant was also produced and is designated below as Formulation E. Formulation E included 13.4 wt % $KNO_3$, 76.6 wt % magnesium, and 10 wt % $Sr(NO_3)_2$ as the illuminant, and 21 wt % $KNO_3$, 38 wt % magnesium, 33 wt % $Sr(NO_3)_2$, and 8 wt % B as the igniter. Formulation E differed from Formulation B in that no boron was present in the illuminant of Formulation E. However, both formulations B and E had the same fuel/oxidizer ratio. Single-component payload formulations were also produced and are designated below as Formulations F and G. In Formulation F, the non-lethal payload included 23.4 wt % $KNO_3$, 57.6 wt % magnesium, 10 wt % $Sr(NO_3)_2$, and 9 wt % boron. No igniter was present. Formulation G included 18.3 wt % $KNO_3$, 71.7 wt % magnesium, and 10 wt % $Sr(NO_3)_2$ as the illuminant. No igniter was present. Formulations F and G had the same fuel/oxidizer ratio.

The shroud of an electric match was inserted and glued into the position normally taken by a primer. The height of the shroud in the primer hold was held constant. Each of the formulations was loaded into a 12-gauge shotshell over the primer. When the non-lethal payload was a dual-component payload, the igniter was loaded into the shotshell first. A ⅛" foam divider was placed over the igniter and the illuminant was loaded over the foam divider. The single and dual-component payloads were added volumetrically to 0.5" of the top of the shell. An over powder plastic sealer was then inserted and pushed into position, the shotshell was crimped, and aluminum tape was added over the crimp. During testing, each shotshell was loaded into a test fixture that enclosed all but the crimped end of the shotshell, promoting a consistent manner by which the shell functions upon ignition. Photopic radiometers were placed axial and radial to the shotshell at a distance of 10 feet. The detector on the pencil gauge was placed one foot front axial to the shotshell. High speed video was recorded axial to the shotshell. The frame of maximum intensity was determined and the pixels showing light were used to determine the fireball area. The diameter of a circle having an equivalent area was determined.

The pressure and light output data for Formulations B and D-G are shown in Table 2. Each formulation was tested in triplicate.

TABLE 2

Pressure and Light Output of Formulations B and D-G

| Formulation | Peak Pressure, (psi) | Axial Peak Photopic (klux) | Axial-0.25 sec. Integrated Photopic (klux * s) | Radial Peak Photopic (klux) | Radial-0.25 sec. Integrated Photopic (klux * s) | Equivalent Radial Fireball Diameter (ft) |
|---|---|---|---|---|---|---|
| D | 5.6 | 307 | 3.2 | 302 | 2.4 | 2.54 |
| D | 4.8 | 255 | 4.4 | 248 | 3.5 | 2.34 |
| D | 6.0 | 270 | 3.4 | 264 | 3.0 | 2.40 |
| D: avg | 5.5 | 278 | 3.7 | 272 | 2.9 | 2.43 |
| D: std dev | 0.6 | 27 | 0.6 | 28 | 0.5 | 0.11 |
| B | 7.6 | 470 | 7.8 | 377 | 6.4 | 2.18 |
| B | 10.3 | 404 | 7.4 | 350 | 6.0 | 2.27 |
| B | 6.2 | 400 | 8.2 | 386 | 6.0 | 2.55 |
| B: avg | 8.0 | 425 | 7.8 | 371 | 6.1 | 2.33 |
| B: std dev | 2.1 | 40 | 0.4 | 19 | 0.3 | 0.2 |
| E | 9.0 | 316 | 5.3 | 288 | 4.0 | 2.1 |
| E | 7.3 | 310 | 6.5 | 221 | 3.7 | 1.77 |
| E | 9.9 | 314 | 6.7 | 264 | 4.6 | 2.16 |
| E: avg | 8.7 | 313 | 6.2 | 258 | 4.1 | 2.01 |
| E: std dev | 1.3 | 3 | 0.8 | 34 | 0.5 | 0.21 |
| F | 5.4 | 507 | 11.2 | 474 | 8.2 | 2.84 |
| F | 5.0 | 478 | 13.3 | 446 | 9.4 | 2.59 |
| F | 4.2 | 467 | 11.6 | 423 | 9.3 | 2.55 |
| F: avg | 4.8 | 484 | 12.0 | 448 | 9.0 | 2.66 |
| F: std dev | 0.6 | 21 | 1.1 | 26 | 0.7 | 0.15 |
| G | No ignition | No ignition | No ignition | No ignition | No ignition | No ignition |
| G | 0.7 | 202 | 10.2 | 218 | 8.4 | 1.96 |
| G | No ignition | No ignition | No ignition | No ignition | No ignition | No ignition |

As shown in Table 2, Formulation B, which included boron in the illuminant and the dry blended igniter and dry blended illuminant, exhibited enhanced light output and pressure impulse relative to Formulation D, which included a mixture of 59.3% magnesium powder, 32.7% UIX-156, and 8.0% UIX-191 granules as the illuminant and a granular igniter. In Formulation E, boron was not present in the illuminant and the only fuel present was magnesium. Formulations B and E had the same fuel-to-oxidizer ratio. The pressure impulse for the shotshells including Formulation E was comparable to that of the shotshells including Formulation B. However, the peak light intensity, integrated light intensity, and fireball area for the shotshells including Formulation E were significantly lower compared to that of Formulation B. The shotshells including Formulation D had comparable pressure impulse to the shotshells including Formulation B. However, the shotshells including Formulation B had greater peak light intensity, integrated light intensity, and fireball area. Thus, the formulation including boron in the illuminant (Formulation B) had enhanced performance in all aspects of light output (peak light intensity, integrated light intensity, and fireball area) relative to formulations lacking boron in the illuminant. Since magnesium and aluminum have been the conventional fuels used in non-lethal payloads, it was unexpected for the formulation containing boron in the illuminant (Formulation B) to exhibit increases in all aspects of light output.

For the single-component payloads, the light output and pressure impulse for shotshells including Formulation F, which included boron, was compared to that of shotshells including Formulation G, which lacked boron. Formulations F and G had the same fuel-to-oxidizer ratio. In addition to having improved light output, the shotshells including Formulation F exhibited improved ignitability and magnitude of pressure impulse.

While the disclosure may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the scope of the following appended claims and their legal equivalents.

What is claimed is:

1. A non-lethal payload, comprising:

at least one fuel, an oxidizer comprising potassium nitrate and strontium nitrate, and at least one of boron or silicon, wherein the at least one of boron or silicon comprises from approximately 1% by weight to approximately 30% by weight of the non-lethal payload and the non-lethal payload is substantially free of a binder, the non-lethal payload comprising 23.4% by weight potassium nitrate, 10% by weight strontium nitrate, 57.6% by weight magnesium, and 9% by weight boron.

2. The non-lethal payload of claim 1, wherein the non-lethal payload comprises a dry mixture of the at least one fuel and the oxidizer.

3. A non-lethal payload consisting of potassium nitrate, strontium nitrate, magnesium, and boron, the non-lethal payload consisting of 23.4% by weight potassium nitrate, 10% by weight strontium nitrate, 57.6% by weight magnesium, and 9% by weight boron.

4. The non-lethal payload of claim 1, wherein the not-lethal payload consists of potassium nitrate, strontium nitrate, magnesium, and boron.

5. A method of forming a non-lethal payload, comprising: combining at least one fuel, an oxidizer comprising potassium nitrate and strontium nitrate, and at least one of boron or silicon in the absence of any solvent, wherein the at least one of boron or silicon comprises from approximately 1% by weight to approximately 30% by weight of the non-lethal payload, the non-lethal payload comprises 23.4% by weight potassium nitrate, 10% by weight strontium nitrate, 57.6% by weight magnesium, and 9% by weight boron, and the non-lethal payload is substantially free of a binder.

6. The method of claim 5, wherein combining at least one fuel, an oxidizer comprising potassium nitrate and strontium, and at least one of boron or silicon comprises combining the at least one fuel, the oxidizer, and the at least one of boron or silicon without a binder.

7. The method of claim 5, wherein combining at least one fuel, an oxidizer comprising potassium nitrate and strontium, and at least one of boron or silicon comprises dry blending the at least one fuel, the oxidizer, and the at least one of boron or silicon.

8. The method of claim 5, wherein combining at least one fuel, an oxidizer comprising potassium nitrate and strontium, and at least one of boron or silicon comprises dry blending potassium nitrate, strontium nitrate, magnesium, and boron.

9. The non-lethal payload of claim 3, wherein the non-lethal payload is substantially free of a binder.

* * * * *